US010315735B2

(12) United States Patent
Mach

(10) Patent No.: US 10,315,735 B2
(45) Date of Patent: Jun. 11, 2019

(54) RETRACTABLE FIN WATERCRAFT ACCESSORY

(71) Applicant: David Mach, Edmonds, WA (US)

(72) Inventor: David Mach, Edmonds, WA (US)

( * ) Notice: Subject to any disclaimer, the term of this patent is extended or adjusted under 35 U.S.C. 154(b) by 0 days.

(21) Appl. No.: 15/449,899

(22) Filed: Mar. 3, 2017

(65) Prior Publication Data

US 2017/0259890 A1 Sep. 14, 2017

Related U.S. Application Data

(60) Provisional application No. 62/389,826, filed on Mar. 11, 2016.

(51) Int. Cl.

| | |
|---|---|
| ***B63B 1/00*** | (2006.01) |
| ***B63B 35/00*** | (2006.01) |
| ***B63B 35/79*** | (2006.01) |
| *B63B 35/71* | (2006.01) |

(52) U.S. Cl.

CPC ..... *B63B 35/793* (2013.01); *B63B 2035/715* (2013.01)

(58) Field of Classification Search

CPC ..... B63B 35/71; B63B 35/79; B63B 35/793; B63B 35/7926; B63B 39/00; B63B 39/06; B63B 41/00; B63B 2035/71; B63B 2035/715; B63B 2035/79; B63B 2035/7903; B63B 2035/813; B63B 2039/00; B63B 2039/06; B63B 2039/065; B63B 2041/00; B63B 2041/003

USPC ..... 441/65, 74, 79; 114/39.15, 278

See application file for complete search history.

(56) References Cited

U.S. PATENT DOCUMENTS 3,066,327 A * 12/1962 Durfey ..... B63B 35/81 441/79
3,082,444 A * 3/1963 Estes ..... B63B 35/81 441/70
3,087,173 A * 4/1963 Meyer ..... B63B 35/81 114/132
3,516,100 A * 6/1970 Ellis ..... B63B 35/793 114/141
4,398,485 A * 8/1983 Diziere ..... B63B 35/793 114/132
4,805,546 A * 2/1989 Geller ..... B63B 35/7926 114/127
4,883,436 A * 11/1989 Oakland ..... B63B 35/7926 114/132

(Continued)

*Primary Examiner* — Daniel V Venne
(74) *Attorney, Agent, or Firm* — Timothy E. Siegel Patent Law, PLLC; Timothy E. Siegel

(57) ABSTRACT

A retractable fin watercraft accessory that provides steering and tracking for a watercraft such as stand-up paddle boards. The retractable fin system gently retracts as it comes in contact with subsurface objects such as rocks, logs and such, allowing the watercraft to freely pass over the object. The system includes a sloped leading edge which can more easily slide past an obstacle. The retractable fin system simply attaches to the watercraft's existing fin mounting box and can be removed from the watercraft without altering the original state of the watercraft prior to being attached. No drilling, welding, gluing or other such custom fabrication is required. The system allows for quick interchangeability between the retractable fin and various rigid style fins, depending on the user's preferences.

9 Claims, 7 Drawing Sheets

(56) References Cited

U.S. PATENT DOCUMENTS

| | | | | | |
|---|---|---|---|---|---|
| 5,129,344 | A * | 7/1992 | Ono | B63B 35/7926 | 114/127 |
| 5,224,435 | A * | 7/1993 | Kinnaird | B63B 35/7926 | 114/127 |
| 5,356,324 | A | 10/1994 | Cunningham | | |
| 5,813,890 | A * | 9/1998 | Benham | B63B 35/7926 | 114/140 |
| 6,068,531 | A * | 5/2000 | Patterson | B63B 35/793 | 441/74 |
| 6,135,837 | A * | 10/2000 | Giles | B63B 35/7926 | 114/39.15 |
| 6,991,504 | B1 | 1/2006 | English et al. | | |
| 7,108,572 | B1 * | 9/2006 | Bennett | B63B 1/042 | 441/79 |
| 7,434,527 | B2 * | 10/2008 | Brighi | B63B 39/06 | 114/126 |
| 8,096,846 | B2 | 1/2012 | Posner et al. | | |
| 9,067,653 | B2 * | 6/2015 | Green | B63B 35/7926 | |
| 9,630,689 | B2 * | 4/2017 | Green | B63B 35/7926 | |
| 2015/0191227 | A1 | 7/2015 | Addison | | |
| 2017/0096199 | A1 * | 4/2017 | Hall | B63B 35/793 | |

* cited by examiner

--PRIOR ART--

RETRACTABLE FIN WATERCRAFT ACCESSORY

CROSS REFERENCE TO RELATED APPLICATIONS

Provisional application No. 62/389,826 filed on Mar. 11, 2016

STATEMENT OF FEDERALLY SPONSORED RESEARCH OR DEVELOPMENT

Not Applicable

THE NAMES OF THE PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

Not Applicable

REFERENCE TO A "SEQUENCE LISTING," A TABLE, OR A COMPUTER PROGRAM LISTING APPENDIX SUBMITTED ON A COMPACT DISC AND AN INCORPORATION BY REFERENCE OF THE MATERIAL ON THE COMPACT DISC

Not Applicable

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates to the field of paddleboards or watercraft suitable for use in water sports or other activities, particularly to a retractable fin for tracking.

BACKGROUND

Watercraft such as stand-up paddle boards, surfboards, kayaks, kite boards, wake boards, and other such watercraft are used in water sports and allow a user to navigate a body of water. A single or multiple fin/skeg (hereinafter "fin") is traditionally used on watercraft to improve directional stability and tracking. They are typically mounted near the aft of a watercraft. Most of these types of watercraft incorporate a fin mounting box which is permanently mounted and embedded into cavities drilled or routed into the underside of the watercraft body. Or in some cases, such as with inflatable watercraft, the fin mounting box is adhered to the underside exterior of the watercraft body. The fin mounting box is designed in such a way that fins can be quickly and conveniently disconnected from a fin mounting box typically with a screw(s) or sometimes with a quick connect latch or other such mechanism, and replaced by different fins or moved forward or aft within the fin mounting box for different stability and maneuverability characteristics.

The drawback with these prior art fin mounting box systems is that the fins are mounted to the fin mounting box in a rigid fashion and cannot retract when coming into contact with subsurface objects. This can be problematic when traveling in shallow waters. When the rigid mount fin comes in contact with and subsurface object, the watercraft can abruptly jerk or stop suddenly. This can result in an uncomfortable experience for the watercraft occupant. In the case of a standing occupant, this could involve falling to ones knees or possibly falling from the watercraft.

Additionally, it is possible that after striking an object, the fin and/or fin mounting box can become damaged. Damage to the marine ecosystems could also occur if the fin was to strike an object such as a coral reef or marine life. The rigid mount fin also has a tendency to catch kelp and other marine debris on its forward edge thereby slowing the watercraft.

Accordingly, there exists a need for a retractable fin system. The prior art has recognized a need for a retractable fin system, as evidenced by several patents disclosing different types of retractable fin systems. Retractable fin system prior art is typically permanently affixed to the watercraft and manufactured integral to the body of the watercraft at the time of initial watercraft assembly. This is because retractable fin system prior art can only operate with a unique fin box mechanism that is custom designed to operate with one specific retractable fin. Other retractable fin system prior art requires expert/professional installation such as drilling, epoxy or gluing. None of the retractable fin prior art can be affixed to the rigid fin mounting box prior art. Additionally, the retractable fin system prior art does not provide the interchangeability benefits that the rigid fin mounting box prior art systems provide such as the ability to be conveniently disconnected from a fin mounting box and replaced by different fins or moved about the fin mounting box for different stability and maneuverability characteristics.

In order to enjoy the benefits of the retractable fin prior art, the watercraft user is either required to purchase an entire watercraft with this feature already fabricated into the hull or they are required to hire an expert/professional to permanently fasten the retractable fin system to a watercraft in some way. Both of these options can be costly and do not provide the versatility of a quick connect, interchangeable and adjustable fin mounting box that the rigid fin prior art provides and is common place in the industry. In both options, the watercraft is permanently modified in order to retain the retractable fin feature.

SUMMARY

The present invention is a retractable fin watercraft accessory that is generally comprised of a fin and bracket apparatus and sometimes, but not always, is further comprised of a position-urging mechanism. The fin provides tracking for a watercraft using a retractable/rotatable vertical blade. The bracket apparatus provides a connection between the fin and the watercraft's existing fin mounting box. Additionally, the bracket apparatus provides a pivot point for the fin. The position-urging mechanism generally consists of a spring or another elastic device which is connected to the fin and to the bracket apparatus. The present invention addresses the shortcoming in the existing rigid fin mount prior art by allowing the fin to gently retract as it comes in contact with subsurface objects such as rocks, logs, coral reef and such allowing the watercraft to freely pass over the object. By doing so, the occupant experiences little to no unsettledness, allowing them to proceed in comfort and confidence. Potential damage to the present invention, fin mounting box and marine ecosystem is also minimized. Trapping of kelp and other marine debris is also minimized. Storage or transport of watercraft is also simplified as multiple watercraft can be stacked adjacent each other without the need to remove the fin.

Additionally, the present invention addresses the shortcomings of retractable fin prior art by the ease in which it can be attached and detached from watercraft. The present invention attaches directly to the watercraft's existing fin mounting box and can be removed from the watercraft without altering the original state of the watercraft prior to being attached. The present invention acts as an accessory to existing watercraft which may have been originally designed to accommodate only rigid mount fins. No drilling, welding, gluing or other such custom fabrication is required. It is intended to be an attachment to a watercraft and not an integral member, allowing the benefits of the present invention without the need to alter or customize the watercraft. The system allows for quick interchangeability between the retractable fin and various rigid style fins, depending on the user's preferences.

BRIEF DESCRIPTION OF THE DRAWINGS

The accompanying drawings illustrate prior art related to the present invention and various example embodiments of the present invention itself which serve to provide context and further clarify the advantages, principles and features of the present invention.

DETAILED DESCRIPTION

Figure 1:
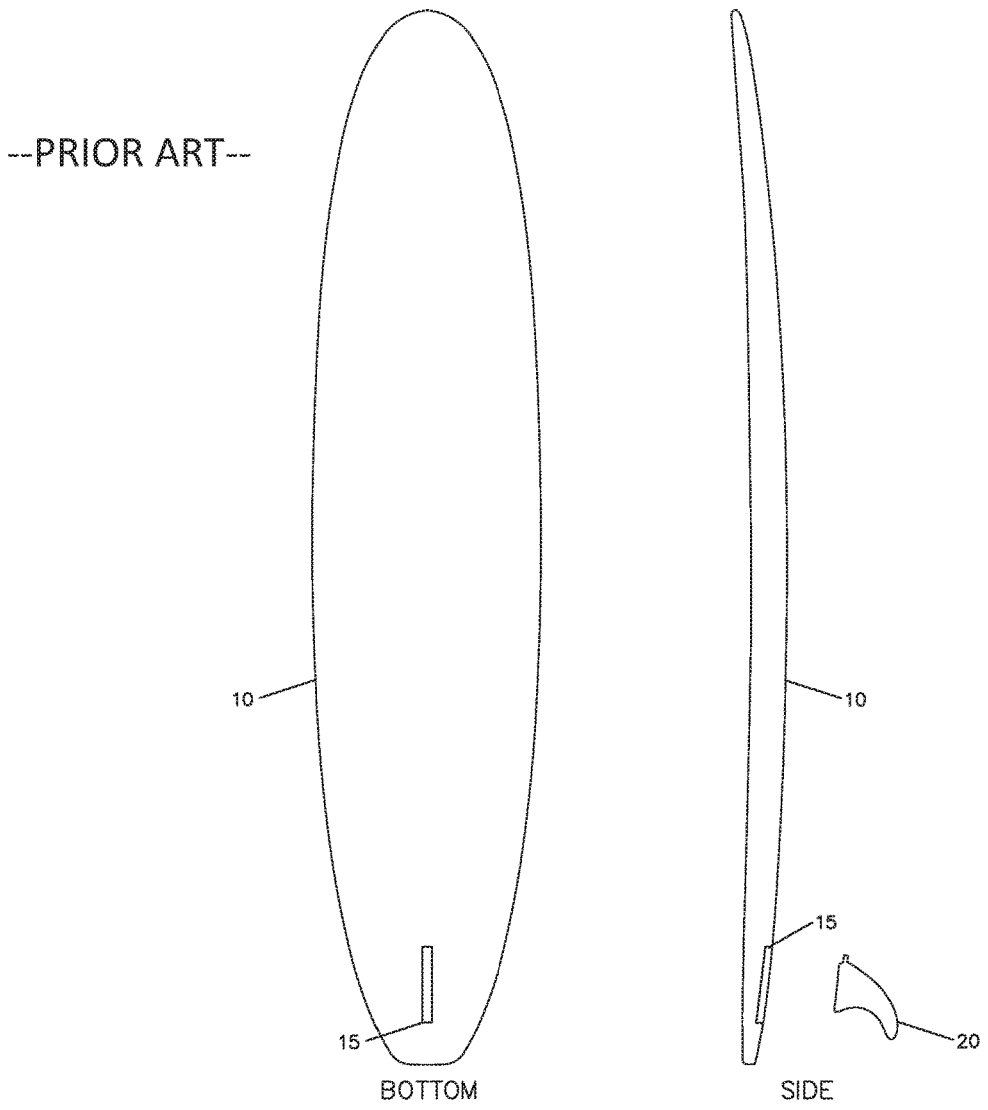
FIG. 1 is a top and side view of a prior art watercraft that includes an example fin mounting box installed in the watercraft body and an example rigid fin.
Figure 2:
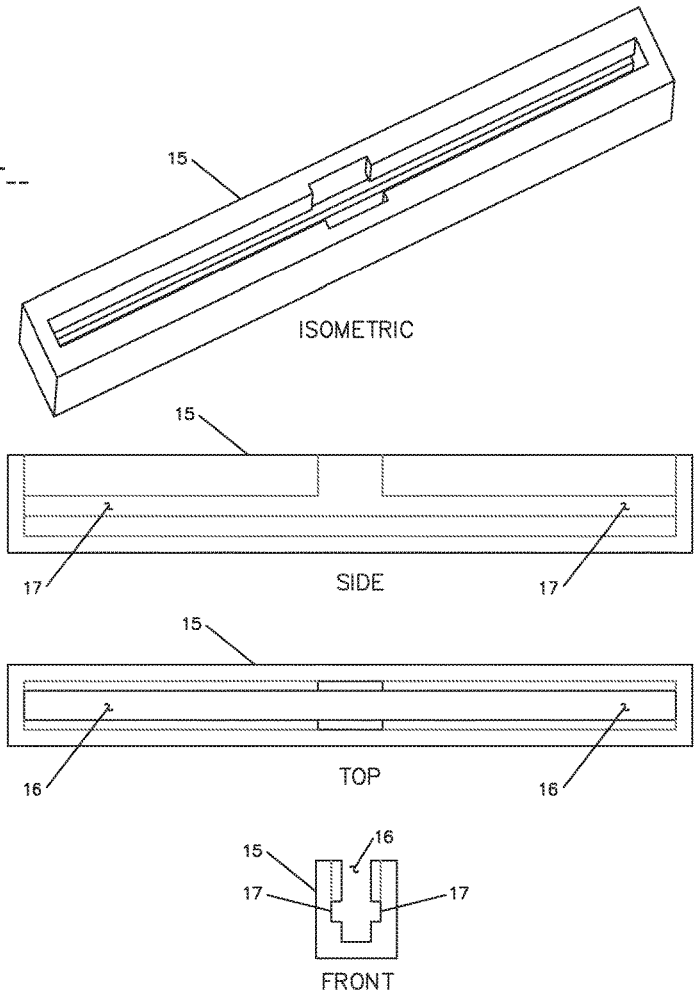
FIG. 2 is an isometric, side, top and front close up view of the prior art fin mounting box shown in FIG. 1.

The components included in FIG. 1 and FIG. 2 are prior art and not part of this present invention but are included to provide context and background. Top and side views of an example watercraft, or more specifically a stand-up paddle board, are illustrated in FIG. 1. FIG. 1 includes a watercraft body 10, fin mounting box 15 installed in the watercraft body 10 and a rigid fin 20. More detail of the fin mounting box 15 is shown in isometric, side, top and front views in FIG. 2. The fin mounting box 15 is permanently mounted and embedded into cavities drilled or routed into the underside of the watercraft body 10. In some cases, such as with inflatable watercraft, the fin mounting box 15 is adhered to underside exterior of the watercraft body 10.

Figure 3:
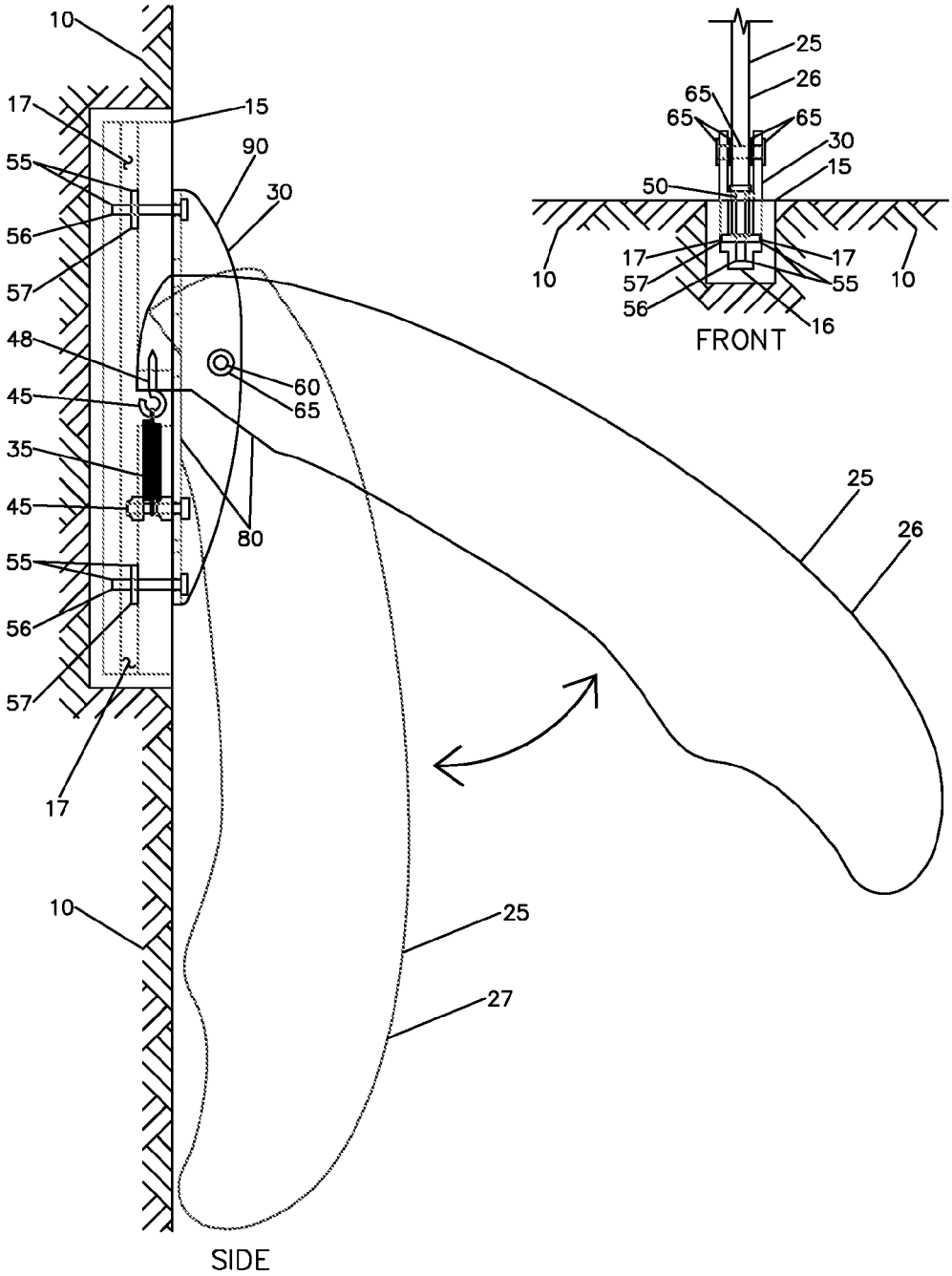
FIG. 3 is a side and front view of the present invention mounted to the prior art fin mounting box shown in FIG. 2. In this embodiment, the position-urging mechanism is shown aft of the pivot point. The fin is shown in both its upright and retracted positions.
Figure 4:
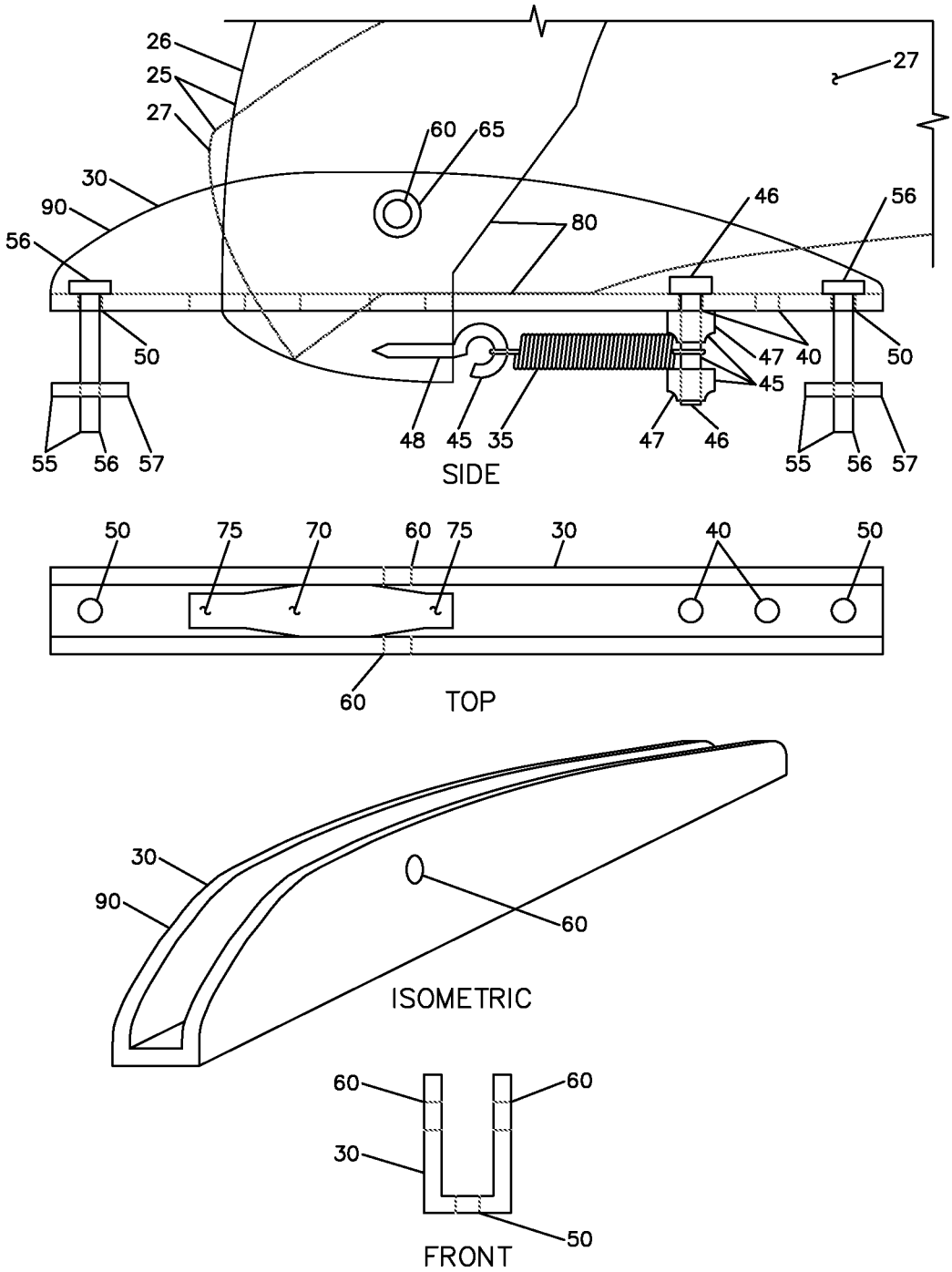
FIG. 4 is a side, top, isometric and front close up view of the present invention shown in FIG. 3. For clarity, the fin is not shown in the top, isometric and front views.

The first illustrated embodiment of the present invention is shown in FIG. 3 and FIG. 4 and is generally comprised of a fin 25, position-urging mechanism 35, bracket apparatus 30 and associated hardware. The fin 25 provides tracking for a watercraft using a retractable/rotatable vertical blade. The fin 25 can be rigid or flexible in nature consisting of a variety of materials including but not limited to, plastic, fiber reinforcement, carbon fiber, aluminum, steel, wood or a combination thereof. The shape and depth of the fin 25 can vary depending on the user's preferences. The fin 25 includes a pivot hole 60 located at its base which is the point at which the fin pivots. The fin 25 pivots about and is connected to the bracket apparatus 30 via pivot mounting hardware 65. Pivot mounting hardware 65 consists of a binder bolt and washers or other such hardware. The fin 25 is illustrated in both the upright position 26 and the retracted position 27. The fin 25 is configured with a unique protrusion on the trailing edge, or fin stop 80, to keep the fin from touching and potentially damaging the watercraft when the fin is in the retracted position 27.

The position-urging mechanism 35 generally consists of a stainless-steel tension spring or other elastic device which is connected to the fin 25 and to the bracket apparatus 30. The fin 25 connection is via a screw eye hook 48 which is mounted to the fin 25. The position-urging mechanism 35 connection to the bracket apparatus 30 is described in detail in the following bracket apparatus 30 paragraphs.

The bracket apparatus 30 provides a connection between the fin 25 and the watercraft's fin mounting box 15. Additionally, the bracket apparatus 30 includes a pivot hole 60 to provide a pivot point for the fin 25.

Additionally, the bracket apparatus 30 includes two position-urging mechanism mounting holes 40, one of which retain the position-urging mechanism mounting hardware 45. The position-urging mechanism mounting hardware 45 consists of a screw 46 with two nuts 47 which are used to retain one end of the position-urging mechanism 35. The second position-urging mechanism mounting hole 40 allows for alternative mounting of the screw 46 and two nuts 47, providing for alternative position-urging mechanism 35 tension.

Additionally, the bracket apparatus 30 includes a bracket apparatus fin slot 70. The purpose of the bracket apparatus fin slot 70 is to allow the position-urging mechanism 35 to remain in the fin mounting box slot 16 and at the same time allow the fin 25 to rotate between the upright position 26 and the retracted position 27. Allowing the position-urging mechanism 35 to remain in the fin mounting box slot 16 minimizes the potential for position-urging mechanism 35 damage due to foreign object impact and also minimizes the risk of bodily injury.

Additionally, the bracket apparatus 30 includes two bracket apparatus fin notches 75. In addition to the pivot mounting hardware 65, the purpose of the two bracket apparatus fin notches 75 is to fit securely around the fin 25 to provide stability to the fin 25 when it is in the upright position 26. The stability minimizes fin 25 vibration and wobble which are undesirable fin attributes.

Furthermore, the bracket apparatus 30 includes two bracket apparatus mounting holes 50 to retain the bracket apparatus mounting hardware 55. The bracket apparatus mounting hardware 55 consists of two screws 56 and two square nuts 57, one set for each bracket apparatus mounting hole 50. The square nuts 57 are inserted into the fin mounting box 15, within the square nut slot 17. Skilled persons will readily recognize the that designation of element 90 as the "forward portion of the leading edge" indicates a directional scheme with, in FIG. 3, the top corresponding to front, and the bottom to rear. Further as FIG. 3 shows a fin for a watercraft, skilled persons will understand that right in FIG. 3, is down or bottom, as this is the direction that the fin projects and watercraft fins do project downwardly into the water. That is to say that skilled persons will readily understand that FIG. 3 shows the water fin assembly rotated counter-clockwise by 90°, from its orientation in use, which is the natural way that skilled persons refer to as directions.

Furthermore, the forward portion of the leading edge 90 of the bracket apparatus 30 is sloped in such a way as to deflect objects. This shape allows the watercraft to "slide over" objects with less resistance following an impact. The bracket apparatus 30 is generally channel shaped in the cross-section view. The shape and depth of the bracket apparatus 30 can vary depending on the user's preferences.

Furthermore, the bracket apparatus 30 is generally rigid in nature consisting of a variety of materials including but not limited to, plastic, fiber reinforcement, carbon fiber, aluminum, steel, wood or a combination thereof.

Having described the structure and components of the first illustrated embodiment, operation will now be explained. The present invention is mounted to the watercraft body 10 via the fin mounting box 15. This is done by placing two square nuts 57 into either end of the square nut slot 17. The present invention is then placed on the fin mounting box 15 with the base of the bracket apparatus resting on the fin mounting box 15. The bracket apparatus mounting holes 50 are then lined up with the square nuts 57. Two screws 56 are inserted through the bracket apparatus mounting holes 50, the two square nuts 57 and then the two screws 56 are tightened. At this point the present invention is fully mounted to the fin mounting box 15 and ready for use.

While under use, if the fin 25 comes into contact with an object, the fin rotates, causing further tension in the position-urging mechanism 35. The fin 25 will either partially rotate or fully rotate into the retracted position 27 and then stop rotation. After the fin 25 is no longer in contact with the object, the position-urging mechanism 35 will compress, causing the fin 25 to rotate back to its full upright position 26 and then stop rotation as it comes in contact with the bracket apparatus fin notch 75.

Figure 5:
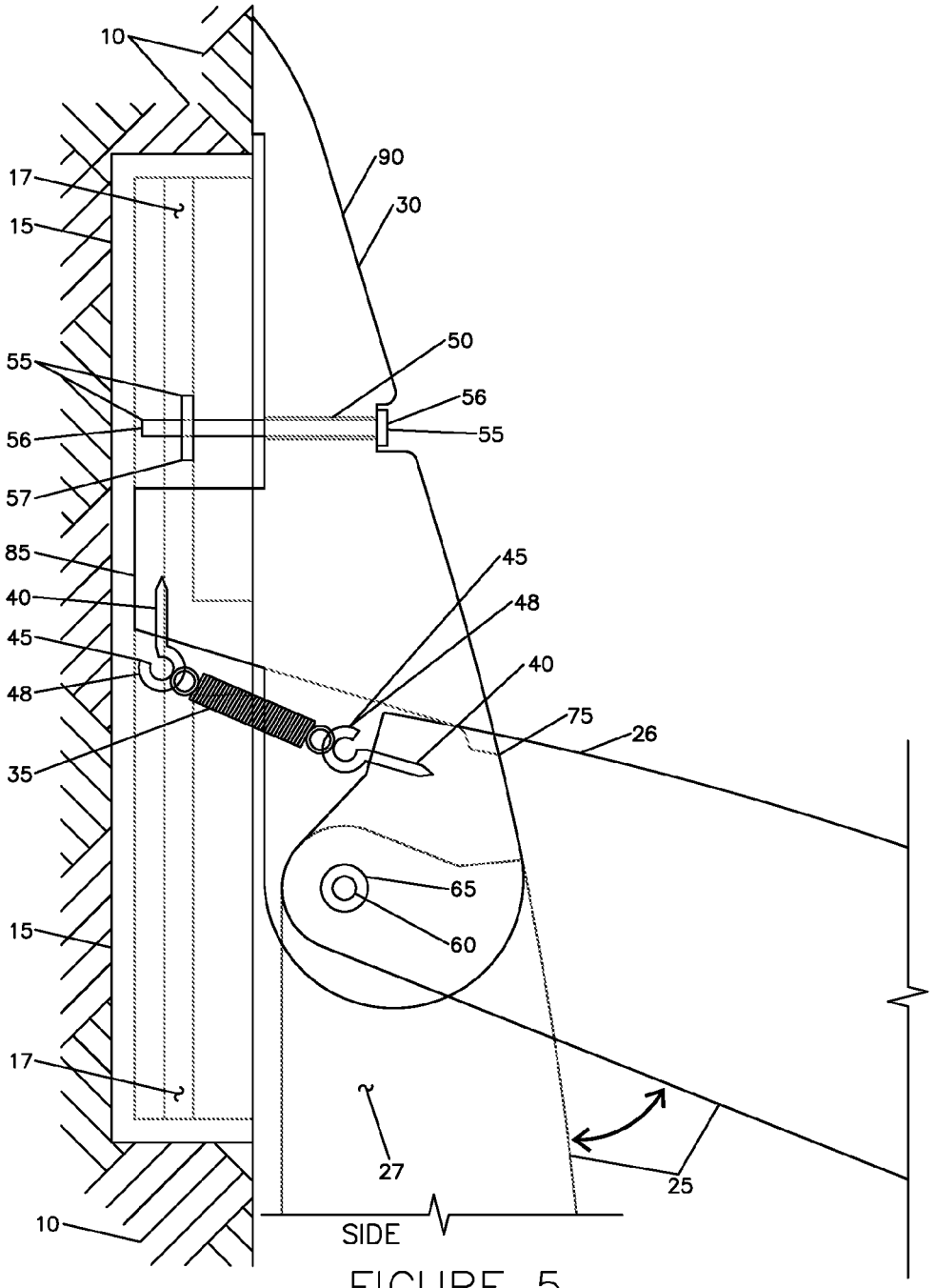
FIG. 5 is a side view of the present invention mounted to the prior art fin mounting box shown in FIG. 2. In this embodiment, the position-urging mechanism is shown forward the pivot point. The fin is shown in both its upright and retracted positions. Only a portion of the fin is shown.
Figure 6:
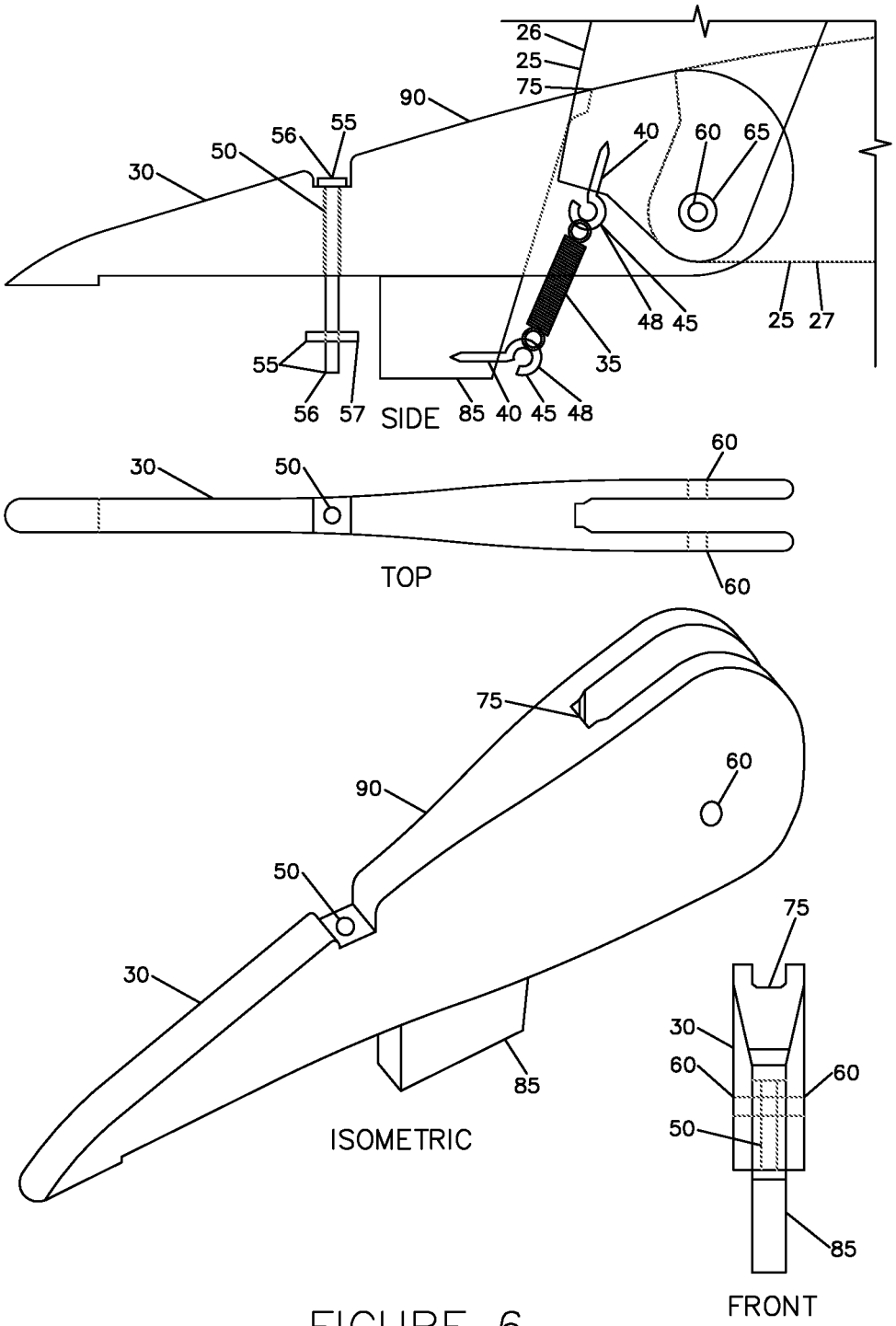
FIG. 6 is a side, top, isometric and front close up view of the present invention shown in FIG. 5. For clarity, the fin is not shown in the top, isometric and front views.

The second illustrated embodiment of the present invention is shown in FIG. 5 and FIG. 6. In this embodiment, the position-urging mechanism 35 is shown forward the pivot hole 60. The bracket apparatus 30 also includes a protrusion 85 which inserts into the fin mounting box slot 16 providing for a sturdy connection between the present invention and the fin mounting box 15.

Furthermore, the forward portion of the leading edge 90 of the bracket apparatus 30 includes a shallower slope than that of the first illustrated embodiment providing less resistance and improved deflection capabilities. The fin 25 shape can complement the leading edge 90 of the bracket apparatus 30 in such a way that it forms a continuous slope when in the retracted position 27 as viewed from the side. With no abrupt angle along the leading edge 90, both the bracket apparatus 30 and the fin 25 smoothly slide past subsurface objects.

Figure 7:
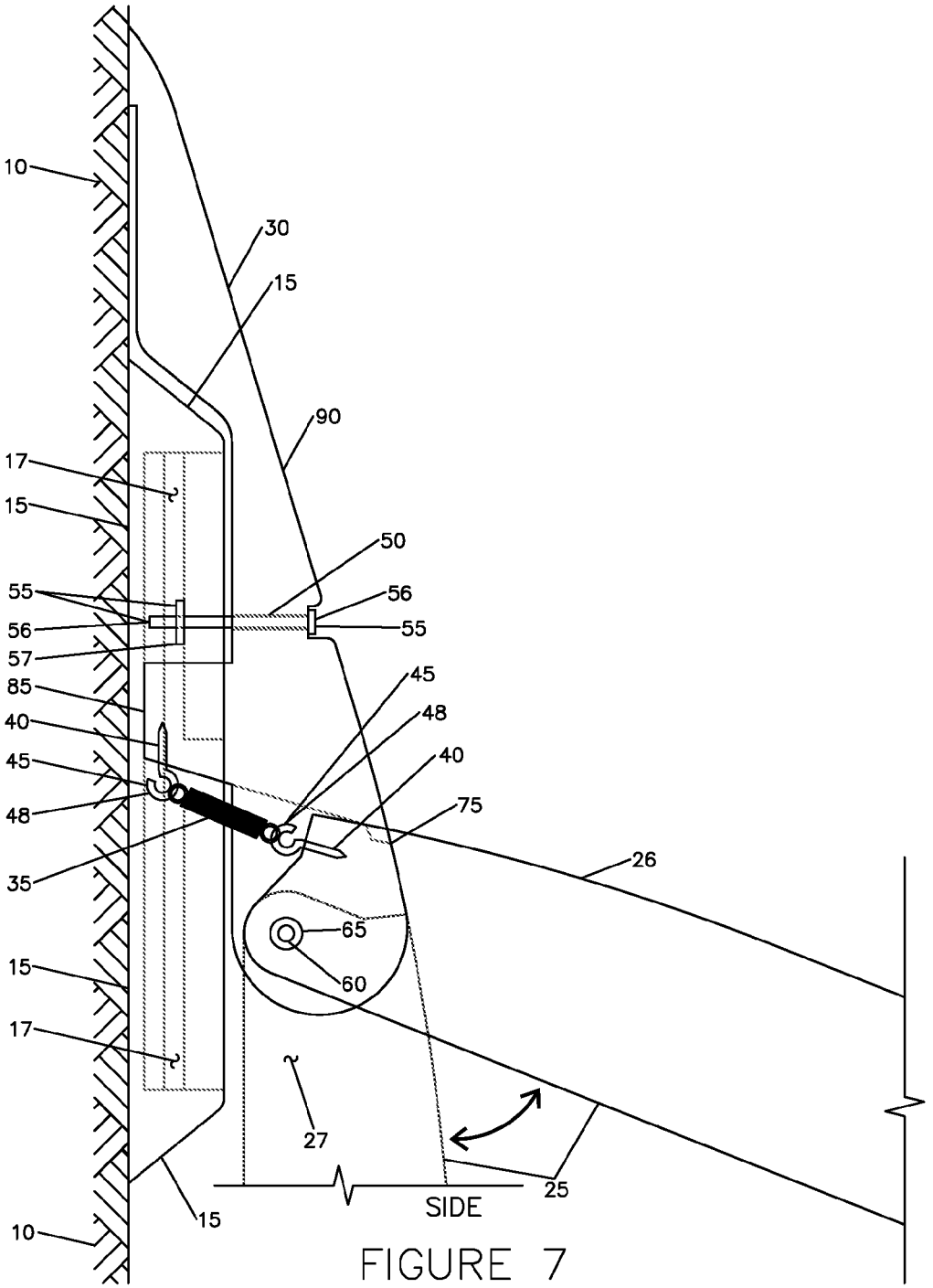
FIG. 7 is a side view of the present invention mounted to the prior art fin mounting box shown in FIG. 2. The prior art fin mounting box is shown attached external to the watercraft's body, as is typically the case for inflatable stand-up paddle boards. In this embodiment, the position-urging mechanism is shown forward the pivot point. The fin is shown in both its upright and retracted positions. Only a portion of the fin is shown.

The third illustrated embodiment of the present invention is shown in FIG. 7. The example fin mounting box 15 is shown attached external to the watercraft body 10, as is typically the case for inflatable watercraft such as stand-up paddle boards. This embodiment is similar to the second embodiment illustrated in FIG. 5. and FIG. 6, with the difference being the leading edge 90 shape of the bracket apparatus 30 which extends forward of the fin mounting box 15. This forward wedge design minimizes the potential for jolting the watercraft when the forward edge of the fin mounting box 15 comes in contact with a subsurface object, allowing the watercraft to slide past the object.

In another embodiment, the present invention could be altered in such a way as to mate the present invention with fin mounting boxes shaped differently from that illustrated in FIG. 2. The shape of the fin mounting box 15 shown in FIG. 2 is for illustrative purposes only and should not be construed as a limitation of the present invention.

Various types of springs placed in various different locations and configurations around the pivot hole 60 and could include compression, tension and torsion which could operate in either tension, compression or torsion.

At least one embodiment of the present invention produces a simple and effective device for a retractable watercraft fin. While a number of embodiments and variations of the present invention have been described in detail herein, these should not be construed as limitations on the scope, but rather as an exemplification of one or more embodiments thereof. Many other variations of size, material, shape, and configurations are possible. For example, the bracket apparatus 30 can take a variety of shapes and sizes and can be adapted to mount to various different types of fin mounting boxes 15 and assemblies. The size of many components can vary. A variety of suitable structural materials could be employed, including steel, aluminum, plastic, wood, composites, and carbon fiber. A variety of fin types, styles, shapes and numbers could be utilized. The present invention could be attached to various types and configurations of watercraft, including stand-up paddle boards, surfboards, kayaks, kite boards, wake boards, rowing shells, crew boats, and various other types of boats, pontoons or floats.

Accordingly, the scope should be determined not by the embodiments identified herein, but by the appended claims and their legal equivalents.

I claim:

1. A watercraft having a front and a back and comprising:

a. a watercraft body;

b. a fin mounting box, defining a fin mounting box slot, said fin mounting box being affixed to said watercraft body;

c. a retractable fin system releasably attached to said fin mounting box, and including:

i. a bracket apparatus, defining a bracket apparatus fin slot, which is aligned to said fin box mounting slot and bracket apparatus mounting hardware that are engaged to said fin mounting box;

ii. a fin, rotatably mounted in said bracket apparatus fin slot to pivot backward from a first position to a retracted position, wherein said fin projects further outwardly from said watercraft body in said first position, providing greater stability for said watercraft, than in said retracted position;

iii. position-urging mechanism, which urges said fin into said first position; and iv. wherein said bracket apparatus has a front portion that slopes downwardly as it extends to the rear, thereby deflecting underwater objects encountered; and d. whereby, when said watercraft is in water, moving forward, with said fin in said first position, and said fin hits an underwater obstruction, said fin rotates backward relative to said fin mounting box, and closer to said watercraft body, permitting said fin to clear said obstruction, after which said position-urging mechanism returns said fin to said first position.

2. The watercraft of claim 1, wherein said position-urging mechanism is a spring mounted between said fin and said bracket apparatus.

3. The watercraft of claim 2, wherein said spring is mounted to said bracket apparatus, by being mounted to a screw, that is mounted to said bracket apparatus and extends into said fin mounting box slot.

4. The watercraft of claim 2, wherein said spring is a metal coil spring.

5. The watercraft of claim 1, further being a stand-up paddleboard.

6. The watercraft of claim 1, wherein said fin in said retracted position extends rearward from said bracket along said watercraft, continuing to provide stability to said watercraft.

7. The watercraft of claim 1, wherein said fin includes a portion which when said fin is in said first position extends into said fin mounting box slot.

8. The watercraft of claim 1, wherein said bracket apparatus further includes a fin slot, thereby permitting a portion of said fin to extend into said fin mounting box slot.

9. The watercraft of claim 1, wherein said bracket apparatus further includes a protrusion that is fitted snugly into said fin box mounting slot.

* * * * *